US012022919B2

(12) United States Patent
Treacy et al.

(10) Patent No.: US 12,022,919 B2
(45) Date of Patent: Jul. 2, 2024

(54) TOP STOP FOR SLIDE FASTENER CHAIN AND METHOD OF DISENGAGING SLIDER FROM SLIDE FASTENER

(71) Applicant: YKK CORPORATION, Tokyo (JP)

(72) Inventors: Alicia Treacy, Runcorn (GB); Shigeyoshi Takazawa, Runcorn (GB); Matthew Rawstron, Runcorn (GB)

(73) Assignee: YKK CORPORATION (JP)

( * ) Notice: Subject to any disclaimer, the term of this patent is extended or adjusted under 35 U.S.C. 154(b) by 0 days.

(21) Appl. No.: 18/001,639

(22) PCT Filed: Jun. 22, 2021

(86) PCT No.: PCT/GB2021/051570
§ 371 (c)(1),
(2) Date: Dec. 13, 2022

(87) PCT Pub. No.: WO2021/260357
PCT Pub. Date: Dec. 30, 2021

(65) Prior Publication Data

US 2023/0232944 A1 Jul. 27, 2023

(30) Foreign Application Priority Data

Jun. 22, 2020 (GB) ..... 2009464

(51) Int. Cl.
*A44B 19/38* (2006.01)
*A44B 19/36* (2006.01)

(52) U.S. Cl.
CPC ..... *A44B 19/386* (2013.01); *A44B 19/36* (2013.01)

(58) Field of Classification Search
CPC ..... A44B 19/386; A44B 19/36; A44B 19/38; Y10T 24/2598
See application file for complete search history.

(56) References Cited

U.S. PATENT DOCUMENTS 1,910,953 A 5/1933 Johnson
4,223,425 A * 9/1980 Akashi ..... A44B 19/36 24/433

(Continued)

FOREIGN PATENT DOCUMENTS

CN 2556968 Y 6/2003
CN 200990922 Y 12/2007

OTHER PUBLICATIONS

Treacy, Alicia; International Search Report and Written Opinion for PCT/GB2021/051570, filed Jun. 22, 2021, mailed Sep. 24, 2021, 13 pgs.

*Primary Examiner* — Robert Sandy
*Assistant Examiner* — Louis A Mercado
(74) *Attorney, Agent, or Firm* — Taylor English Duma LLP

(57) ABSTRACT

A top stop for a slide fastener includes a first body portion, which includes a channel having an inlet at a first side of the top stop and an outlet at a second side of the top stop. The channel is defined by a channel first side wall and a channel second side wall, and a channel bottom surface therebetween. The channel second side wall includes a protruding portion, which defines an abutment protrusion in the channel. A distance parallel to the longitudinal axis of the top stop between the channel first side wall and channel second side wall defines a channel width. The channel width extending from the abutment protrusion to the channel first side wall is less than the channel width at the inlet and the channel width at the outlet.

17 Claims, 14 Drawing Sheets

(56) References Cited

U.S. PATENT DOCUMENTS

| | | | | | |
|---|---|---|---|---|---|
| 4,232,431 | A * | 11/1980 | Akashi | A44B 19/36 | 24/388 |
| 4,878,275 | A * | 11/1989 | Kazui | A44B 19/36 | 24/388 |
| 5,860,193 | A * | 1/1999 | Wang | A44B 19/386 | 24/429 |
| 6,070,306 | A * | 6/2000 | Wang | A44B 19/386 | 24/429 |
| 6,327,755 | B1 * | 12/2001 | Wang | A44B 19/386 | 24/409 |
| 6,715,187 | B1 * | 4/2004 | Wang | A44B 19/386 | 24/436 |
| 2005/0060848 | A1 | 3/2005 | Tsaur | | |
| 2023/0232944 | A1 * | 7/2023 | Treacy | A44B 19/36 | 24/435 |

* cited by examiner

TOP STOP FOR SLIDE FASTENER CHAIN AND METHOD OF DISENGAGING SLIDER FROM SLIDE FASTENER

TECHNICAL FIELD

The present application relates to top stops for slide fastener chains and slide fastener chains including such top stops. The application also relates to methods of disengaging a slider from a slide fastener.

BACKGROUND ART

Conventional slide fasteners (or zips or zippers) include a pair of stringers and an opening and closing means commonly referred to as a slider. Each stringer includes a tape and a plurality of coupling elements. The coupling elements extend along a first edge of each tape and when the slider of the slide fastener has been moved to a closed position, corresponding coupling elements of the stringers interdigitate, couple or interlock. When each tape of the slide fastener is attached to separate portions of an article, the separate portions of the article may be releasably joined by closing the slide fastener by moving the slider to the closed position, and thereby bringing the coupling elements into above interdigitating relationship.

Slide fasteners are therefore both useful and versatile and are employed in a range of applications including garments, furnishings and luggage. Known slide fasteners are generally constructed as follows.

A coupling portion, usually in the form of a plurality of coupling elements (also referred to as teeth) is attached to a first edge of a tape to form a stringer. This first edge may be referred to as the coupling edge of the stringer. The tape can be woven or knitted and may be formed from, for example, polyester. The coupling elements may be attached to the tape by, for example, crimping or molding the coupling elements onto a reinforced edge of the tape. In some cases, the reinforced end may include a cord, and the cord may be sewn or woven into the tape. Alternatively, the coupling elements may be formed as a continuous coil. In this case, the coupling elements are most commonly stitched to a surface of the tape at the edge of the tape or, alternatively, are woven or knitted into the tape.

Two stringers are brought together, such that the coupling elements of each stringer can attach to one another, for example, by interdigitating, to form a chain. The chain is generally planar, and the chain (and the coupling elements which form part of the chain) extends along a longitudinal axis of the chain. A slider is mounted to the chain onto coupling elements of each respective stringer such that the slider can move along the chain between the two stringers.

The slider commonly includes a main body having an upper and lower blade through which the coupling elements of each stringer pass. A pull tab or pull cord is attached to the main body which may be grasped by a user in order to effectively move the slider along the chain. The main body includes a guide post (sometimes referred to as a diamond) which, in part, defines a Y-shaped channel which is configured to carry coupling elements of the first and second stringers. The slider can include upper flanges and lower flanges which are disposed on each of the right and left side edge parts of the upper and lower blades, that is, the edges of the slider substantially parallel to a direction of operation of the slider. The flanges provided on the upper blade protrude downwards towards the lower blade and flanges provided on the lower blade protrude upwards towards the upper blade. The flanges are configured for sliding engagement with the coupling elements.

Movement of the slider along the chain in a first sliding direction along an axis of operation of the slider causes the coupling elements of the first stringer to attach to the coupling elements of the second stringer. When the slider is no longer able to couple elements any further in the first sliding direction i.e. substantially all the coupling elements of the first stringer are attached to substantially all the coupling elements of the second stringer, the slide fastener may be regarded as being in a fully closed configuration. Movement of the slider along the chain in a second sliding direction, along the axis of operation of the slider, opposite to the first sliding direction, causes the coupling elements of the first stringer to detach from the coupling elements of the second stringer. When the slider is no longer able to uncouple elements any further in the second sliding direction i.e. substantially all the coupling elements of the first stringer are detached from the coupling elements of the second stringer, the slide fastener may be regarded as being in a fully open configuration.

The chain is cut to a desired length to form a desired length of slide fastener. Stops (often referred to as top stops and bottom stops) may be attached to either or both ends of the chain. The stops limit the extent of movement that the slider can undertake along the chain. It is usually the case that a top stop limits movement of the slider in the first sliding direction and a bottom stop limits movement of the slider in the second sliding direction. Typically, stops may be used in order to limit the movement of the slider along the chain. Typically, the slider is no longer able to couple or uncouple elements, or move, when the slider abuts on a stop of some variety, such as a bottom stop or a top stop. The top stop may be configured to abut on a top portion of the slider, for example a top edge of a flange provided on the slider main body, and may limit the travel of the slider in the first sliding direction. The bottom stop may be configured to abut on a bottom portion of the slider, for example a bottom edge of a flange provided on the main body of the slider, and may limit the travel of the slider in the second sliding direction. Stops may also be configured to abut on the upper or lower blades of the slider.

Some slide fasteners may have a single bottom stop which is attached to both the first and second stringers. Other slide fasteners, which may be referred to as separating slide fasteners, may have two separate bottom stops each attached to a corresponding each one of the stringers. The two bottom stops may take the respective forms of a retainer box and an insertion pin. The insertion pin can be inserted into the retainer box in order to interlink the first and second stringers with each other. Conversely, the insertion pin can be removed from the retainer box when the slider is located adjacent the retainer box in order to pass through the slider and to separate the first and second stringers from each other.

Some slide fasteners may have two separate top stops, each being attached to a corresponding one of the stringers. Other slide fasteners may have a single top stop attached to one or both of the stringers.

SUMMARY OF INVENTION

Technical Problem

The at least one top stop limits movement of the slider in the first sliding direction in order to prevent the slider from disengaging from the coupling elements and hence the slide fastener. However, there may be situations where it is necessary to remove the slider, for example if the slider is broken and needs to be replaced. In some cases, misalignment of the coupling elements may occur and the slider needs to be removed in order to correct this deficiency. The top stop may be formed on the tape prior to attachment of the slider. For example, the top stop may be crimped or molded onto a reinforced edge of the tape. In some cases, it may be desirable for the top stop to allow for the slider to be mounted on the coupling elements of the stringers after the one or more top stops have been affixed to their respective stringer. For example, if fastener chain is first sewn to a garment without a slider because of some impediment, it may be desirable to mount the slider after sewing.

It is desirable to provide a top stop which overcomes problems with known slide fasteners, whether discussed above or otherwise. It is also desirable to provide an alternative design of top stop.

Solution to Problem

According to an aspect of the present application, there is provided a top stop for a slide fastener. The top stop may include a first body portion. The first body portion may include a channel having an inlet at a first side of the top stop and an outlet at a second side of the top stop, the second side being opposite the first side. The channel is configured to receive a portion of a slider of the slide fastener. The channel may be defined by a channel first side wall and a channel second side wall, and a channel bottom surface therebetween. The channel second side wall includes a protruding portion which defines an abutment protrusion in the channel. The top stop may include a longitudinal axis which is parallel to an axis of operation of a slider. A distance parallel to the longitudinal axis of the top stop between the channel first side wall and channel second side wall defines a channel width. The channel width extending from the abutment protrusion to the channel first side wall is less than the channel width at the inlet and the channel width at the outlet.

A top stop according to the present application allows for easy insertion of a slider onto the stringers of a slide fastener chain and prevents accidental detachment of the slider during use of the slide fastener. The top stop also facilitates the removal of the slider, should this be required, for example to replace a broken or faulty slider.

The abutment protrusion may be configured to restrict travel of the portion of the slider along the channel, when the portion of the slider is received in the channel and is translated from the outlet towards the inlet in order to release the slider from a stringer of the slide fastener. The abutment protrusion may therefore provide a stop to prevent further travel of the slider along the channel, preventing accidental disengagement of the slider from the slide fastener.

A distance between the abutment protrusion and the second side of the top stop in a direction perpendicular to the longitudinal axis of the top stop, may be selected such that when the portion of the slider is in contact with the abutment protrusion, the portion of the slider can be pivoted around a pivot point formed on the channel first side wall at the outlet of the channel.

The abutment protrusion may define a release point for the portion of the slider. The distance determines force required to pivot the portion of the slider beyond the release point and through the abutment protrusion. Accordingly, the top stop may be tailored such that a minimum force is required to pivot the slider past the release point. The top stop may be tailored to provide for different specifications of the slide fastener, for example, in the case where quick and easy release of the slider is required, the distance between the release point and the outlet may be relatively short.

The channel first side wall may extend at a constant incline from the inlet of the channel to the outlet. This may facilitate ease of entry for the slider to be translated from the inlet and through the channel and into sliding engagement with the row of coupling elements provided on the string fastener.

The channel second side wall may include a second protruding portion defining an outlet protrusion adjacent the outlet of the channel. The outlet protrusion may be configured to prevent the portion of the slider from entering the outlet of the channel.

The channel second side wall having the protruding portions provides a channel with varying widths. The channel width at the inlet and the outlet may be smaller than any channel width intermediate the outlet protrusion and the abutment protrusion. The channel width at the inlet may be larger than the channel width at the outlet.

The top stop may further include a stop portion located above the outlet of the channel. The stop portion may be configured to limit travel of the slider along a chain of the slide fastener by abutment with the portion of the slider. The stop portion may be located beyond the outlet of the channel when the top stop is orientated for normal use. As such, the top stop may function to prevent the slider from disengaging from the chain during normal use of the slide fastener.

A stringer of a slide fastener may include a tape having a first planar surface and a second planar surface with a coupling edge to which coupling elements are attached, and an outer edge which is opposite and parallel to the coupling edge.

According to other aspect of the present application, there is provided a slide fastener chain. The slide fastener chain may include a first stringer having a row of first coupling elements attached to a coupling edge of the first stringer and a second stringer having a row of second coupling elements attached to a coupling edge of the second stringer. The first and second stringers are attached to and detached from each other by interdigitating and uncoupling of the rows of the first and second coupling elements. At least one of the first and second stringers may be provided with the top stop according to the previous aspect.

The row of first and row of second coupling elements may be teeth coupling elements. Alternatively, the row of first and row of second coupling elements may be formed by respective coil members.

The top stop may be attached to the coupling edge of at least one of the first and second stringers.

The top stop may be located in line with the first or second coupling elements.

The top stop may include an inner portion on an inner side of the coupling edge and an outer portion on an outer side of the coupling edge. The inlet of the channel may be located on the inner portion, and the outlet of the channel may be located on the outer portion.

The first body portion of the top stop may be mounted on a first planar surface of at least one of the of the first and second stringers.

In some examples, the top stop may be provided for use with a stringer having coupling elements on one planar surface of the tape, for example a coiled fastener. In the case, the slider may normally include only a single pair of flanges extending from one of the upper or lower blades of the slider main body (e.g. corresponding to the side of the stringer from which the coil extends) to engage the coupling elements and accordingly, the top stop having a channel formed on the first body portion for mounting on the corresponding planar surface of the stringer having the coupling elements will be sufficient to allow the removal of the slider from the slide fastener chain.

The top stop may further include a second body portion for mounting on a second planar surface of the at least one of the first and second stringers, and the second body portion includes a second channel substantially identical to the channel of the first body portion.

In some examples, the top stop may be provided for use with a stringer having coupling elements on or crimped or molded to both planar surfaces of the tape of the stringer, for example a stringer having teeth-like coupling elements. In the case, the slider may normally include two pairs of opposing flanges (one on each side of said slide fastener chain) to engage the coupling elements. The top stop having a channel formed in first and second body portions which may be mounted on opposing planar surfaces of the tape of the stringer will allow opposing flanges of the slider to be translated through the top stop on each side of the slide fastener, facilitating ease of removal.

Alternatively, the second body portion may include a second channel having an inlet and an outlet, a channel first side wall and a channel second side wall. The distance between the channel first and second side walls defines a channel width, and the channel width of the second channel may be substantially constant. The channel width may be sufficient to allow a flange of a slider to be translated through the channel. A top stop having a channel with protruding portions on a first body portion, and a constant width channel on a second body portion may facilitate ease of removal of a slider having two pairs of opposed flanges as the slider only needs to rotate through a single abutment protrusion provided on one face.

The channel second side wall may include an incline from the inlet of the channel to the abutment protrusion having a constant angle relative to the longitudinal axis of the top stop from the inlet of the channel to the abutment protrusion. The channel may therefore function as guide to direct the flange of the slider through the channel and the slider into sliding engagement with adjacent coupling elements.

The channel second side wall may include a first incline and a second incline. The first incline extends from the inlet to the second incline at a first angle relative to the longitudinal axis of the top stop. The second incline extends between the first incline and the abutment protrusion at a second angle relative to the longitudinal axis of the top stop. The second angle is less than the first angle. This may provide an additional barrier to prevent accidental disengagement of a slider from the slide fastener chain because the narrow width and shallow angle of the second incline of the channel second side wall will require further deliberate manipulation to allow the slider to pass through this second portion to allow subsequent release from the slider fastener chain.

The inlet of the channel may be provided with a recess. This may make it easier for a user to insert a flange of the slider into the channel. This may also facilitate formation of the top stop onto the coupling edge of the stringer. For example, the top stop may be molded by injection onto the coupling edge of at least one of the first and second stringers.

The channel bottom surface may be formed by the stringer to which the top stop is attached. In this regard, the first or second or both body portions may include two distinct sections which are separated by the channel width, thereby forming the channel in between the sections. Alternatively, the bottom surface of the channel may include the same material as the top stop. In such cases, the first or second or both body portions may include a singular component having the channel formed in the first or second or both body portions, respectively.

The top stop may be formed from any suitable material, for example, the top stop may include a polymer material such as polyester, polyacetal, or polyethylene, or the top stop may be metal based, such as aluminium, nickel or the like.

According to other aspect of the present application, there is provided a slide fastener. The slide fastener may include a slide fastener chain according to the previous aspect, and a slider configured to be mounted to the first and second stringers to provide for selectively interdigitating and uncoupling of the first and second coupling elements.

According to other aspect of the present application, there is provided an article including a slide fastener. The slide fastener includes: a first stringer having first coupling elements and a second stringer having second coupling elements, and a slider configured to be mounted to the first and second stringers to provide for selectively interdigitating and uncoupling of the first and second coupling elements. The first stringer includes a first tape and the second stringer includes a second tape; and the first tape is attached to a first portion of the article and the second tape is attached to a second portion of the article. At least one of the first and second stringers is provided with a top stop according to the previously described aspects.

According to other aspect of the present application, there is provided a method of disengaging a slider from a slider fastener. The method includes: translating a portion of a slider into a channel provided in a top stop of the slide fastener, the channel being defined by a channel first side wall and a channel second side wall; abutting the portion of the slider against an abutment protrusion provided on the channel second side wall; pivoting the slider about a pivot point on the channel first side wall at the outlet to the channel, such that the portion of the slider is rotated through a release point defined on the abutment protrusion; and translating the portion of the slider through remaining channel to an inlet, such that the slider is removed from the top stop.

The method may further include rotating the slider such that the portion of the slider can rotate through an outlet protrusion provided on the second side wall adjacent the outlet of the channel.

It should be recognised that features defined in relation to one aspect may, where appropriate, be applied in relation to any other aspect.

BRIEF DESCRIPTION OF DRAWINGS

These and other aspects of the present application will now be described, by way of example only, with reference to the accompanying drawings.

DESCRIPTION OF EMBODIMENTS

Figure 1:
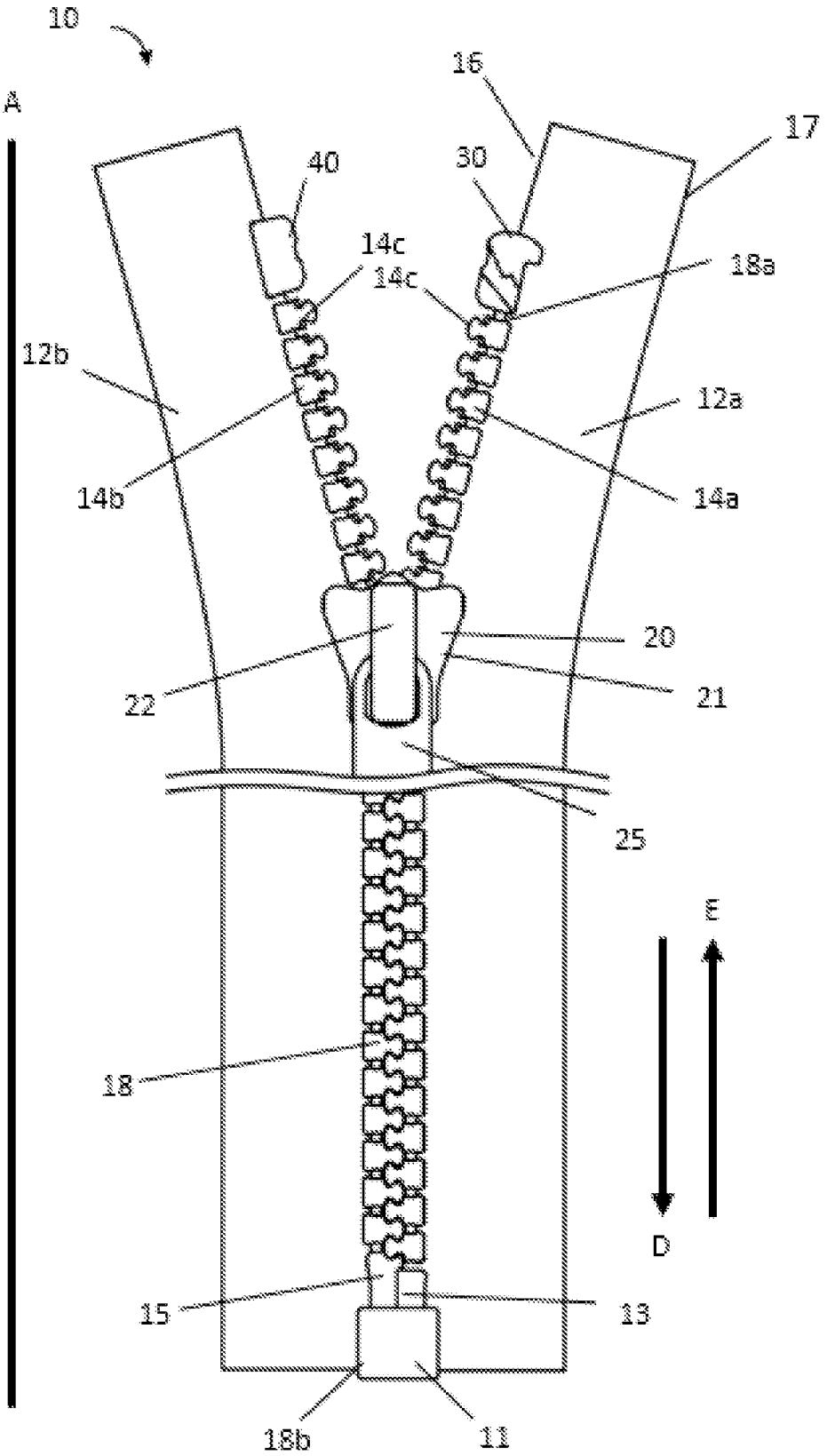
FIG. 1 illustrates a slide fastener having a top stop according to the present application.

FIG. 1 shows a slide fastener 10. The slide fastener 10 includes a slider 20 and a pair of stringers 12*a*, 12*b*. Each stringer includes a coupling portion in the form of a row of coupling elements 14*a*, 14*b* which are attached to an edge of a tape of each stringer. The edge to which the coupling elements are attached may be referred to as the coupling edge 16. The tape may be woven or knitted and may be formed from, for example, synthetic fibres such as polyester, vinylon or polyurethane and/or natural fibres such as cotton. The coupling elements 14*a*, 14*b* may be molded, as shown in FIG. 1, or crimped teeth (not shown) or as a continuous coil with coil elements forming the coupling elements (not shown). In this embodiment, the tape of the stringer 12*a*, 12*b* may be provided with a reinforced edge including a cord 16*a* (shown in FIG. 2), onto which the coupling elements 14*a*, 14*b* are attached. The presence of the reinforced edge on the stringer 12*a* is optional.

The tape of each stringer includes a first planar surface and a second planar surface opposite to the first planar surface. The first planar surface and the second planar surface join at the coupling edge 16 including the coupling elements 14*a*, 14*b* and the cord 16*a* to which they are attached so that the coupling elements 14*a*, 14*b* encompass the coupling edge 16 of both the first planar surface and the second planar surface. The coupling elements 14*a*, 14*b* include a head potion 14*c* in which is provided an engagement member which allows engagement with a head portion 14*c* of an opposing coupling element of a cooperating stringer. The tape also includes an outer edge which is opposite and parallel to the coupling edge 16.

The two stringers 12*a*, 12*b* are brought together, such that the row of coupling elements 14*a*, 14*b* of each stringer 12*a*, 12*b* can attach to each other, by interdigitating. The slide fastener chain 18 includes the two stringers 12*a*, 12*b* and extends along a longitudinal axis A of the slide fastener 10. This axis is also known as the axis of operation.

The slider 20 is attached to the slide fastener chain 18 such that the slider 20 can move along the rows of coupling element between the two stringers 12*a*, 12*b*. The slider 20 includes a slider body 21. The slider body 21 of the embodiment has an upper blade 23, a lower blade (not shown) disposed separately to be parallel to the upper blade 23, a guide post 26 connecting front end parts of the upper blade 23 and the lower blade. Upper flanges 24*a*, 24*b* and lower flanges (not shown) are disposed on each of the right and left side edge parts of the upper 21 and lower blades, that is, the edges of the slider substantially parallel to the direction of operation of the slider. A pull tab 25 is disposed on an upper surface of the upper blade 23 via a bridge portion 22. This pull tab 25 may be grasped by a user in order to effectively move the slider 20 along the rows of coupling elements.

At the front end of the slider body 21, right and left shoulder mouths 21*a*, 21*b* are formed interposing the guide post 26, and a rear mouth 21*c* is formed at a rear end of the slider body 21. Between the upper blade 23 and the lower blade, the guide post 26 communicates the right and left shoulder mouths 21*a*, 21*b* and the rear mouth 21*c*, and a substantially Y-shaped channel is formed within the slider 20 and between the blades.

In order to engage or disengage the slide fastener 10, the row of coupling elements 14*a* of the first stringer 12*a* passes through the right shoulder mouth 21*a* and along the portion of the Y-shaped channel extending from the right shoulder mouth 21*a* until coming into releasably coupling contact with the row of coupling elements 14*b* of the second stringer 12*b*. And the row of coupling elements on the second stringer 12*b* passes along the portion of the Y shaped channel extending from the left shoulder mouth 21*b* when entering the portion of the Y shaped channel extending from the rear mouth. It can be understood that only one row of coupling elements may be inserted into the slider 20 then the slider 20 may be able to travel along the row of coupling elements in the engaging and disengaging directions. Further, there is an insertion gap (not shown) between the upper flanges 24*a*, 24*b* and lower flanges of the slider body 21, into which a part of the tape of the stringer is inserted. Using a slider 20 having the above mentioned structure enables the smooth coupling and separating of the right and left rows of coupling elements 14*a* 14*b* of the first and second stringers 12*a* 12*b*.

In some embodiments, flanges may only extend from either the upper blade or the lower blade. FIG. 9A to 9D show an example top stop according to the present application which would be appropriate for such a slider.

Movement of the slider 20 along the rows of coupling elements 14*a*, 14*b* in a first sliding direction E causes the coupling elements 14*a* of the first stringer 12*a* to attach to the coupling elements 14*b* of the second stringer 12*b*. Movement of the slider along the chain in a second sliding direction D, opposite to the first sliding direction E, causes the coupling elements 14*a* of the first stringer 12*a* to detach from the coupling elements 14*b* of the second stringer 12*b*. Attached coupling elements are also known as coupled coupling elements, engaged coupling elements or paired coupling elements. The process of attaching coupling elements is also known as coupling, engaging or pairing.

Top stops 30 and 40 are provided at the top end 18*a* of the coupling elements rows 14*a*, 14*b*. In this example, a different top stop is provided at the top end of each row of coupling elements 14*a*, 14*b*. However, it can be understood that in some cases only a single top stop 30 may be required (i.e. as part of only one of the stringers), and/or that each top stop 30, 40 may be identical. The top stops may be formed from any suitable material, for example, they may include a polymer material such as polyester, polyacethal, or polyethylene, or they may be metal based, such as aluminium, nickel or the like.

A retainer box 11 is provided at the bottom end 18*b* of the row of coupling elements 14*a*, 14*b*, on the opposite side of the row to the top end 18*a* of the row of coupling elements 14*a*, 14*b*, into which an insertion pin 15 can be inserted in order to interlink the first and second stringers 12*a*, 12*b*. A box pin 13 provided on stringer 12*a* may be permanently fixed into the retainer box, therefore insertion pin 15 may be removed from the retainer box 11 when the slider 20 is located adjacent the retainer box 11, in order to pass through the slider 20 and separate the first and second stringers 12*a*, 12*b* from each other. The stringers 12*a*, 12*b* can therefore be separated. When the stringers 12*a*, 12*b* are separated, the slider 20 is retained on stringer 12*a* to which the retainer box 11 is attached. Slide fastener 10 is therefore an example of an open ended string fastener 10.

It can be understood that the foregoing description of top stop 30 and top stops 130, 230 and 330 as described later according to the present application may have applicability in all types of slide fastener and are not limited to the example shown in accompanying drawings.

Figure 2:
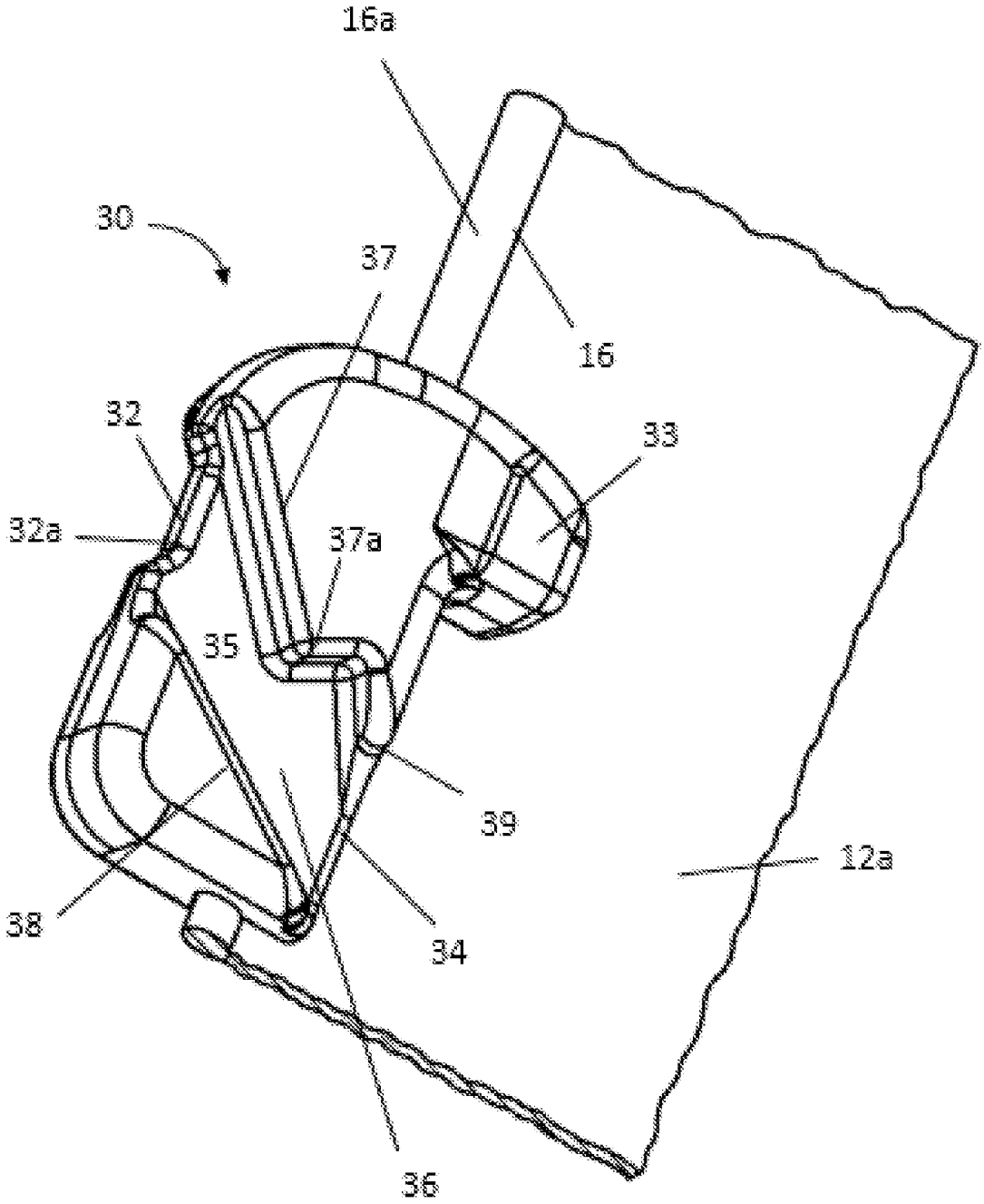
FIG. 2 is a perspective view of the top stop shown in FIG. 1 on a slider fastener.

A perspective view of top stop 30 attached to the coupling edge 16 including a cord 16*a* (or reinforced edge) of stringer 12*a*, is shown in FIG. 2. In the case where there is no reinforced edge provided, the top stop may be attached directly to the coupling edge of the tape.

Figure 3A:
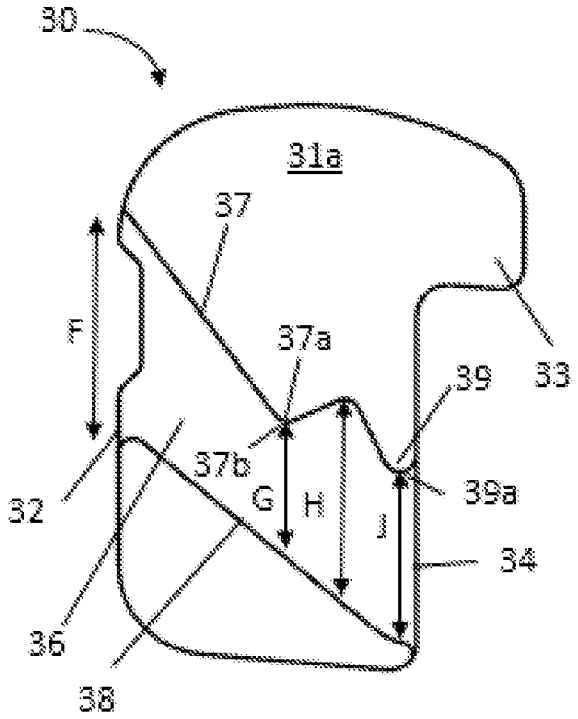
FIG. 3A illustrates front view of the top stop according to the present application.
Figure 3B:
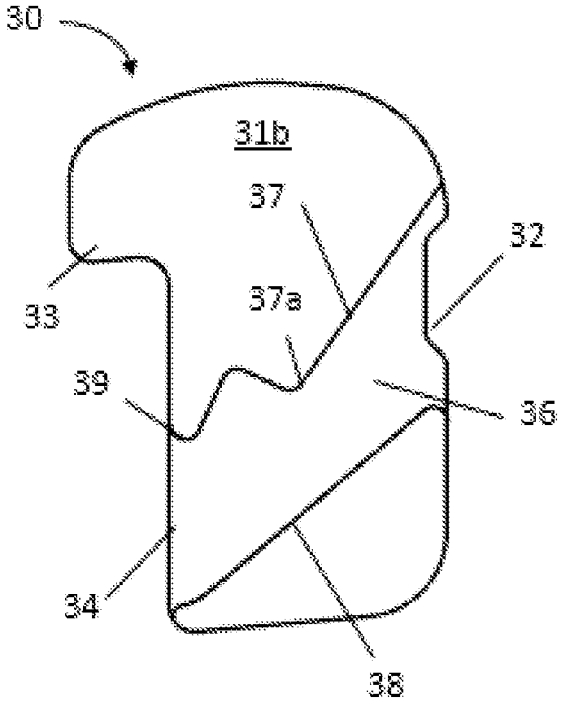
FIG. 3B illustrates back view of the top stop according to the present application.
Figure 3C:
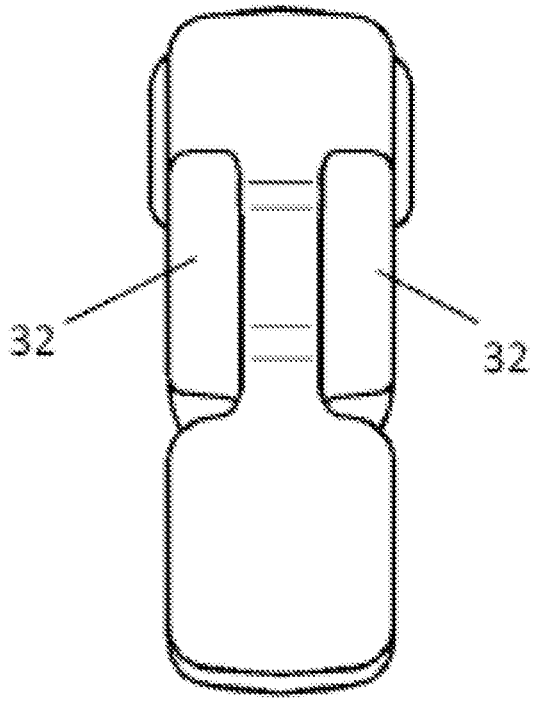
FIG. 3C illustrates side view of the top stop according to the present application.
Figure 3D:
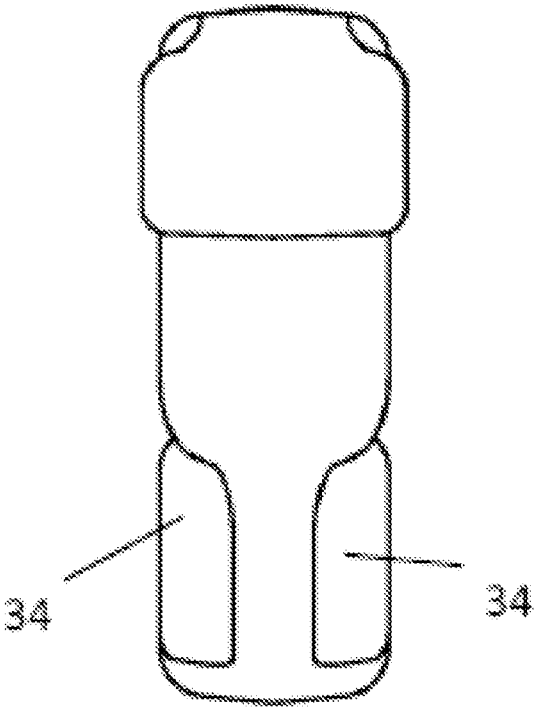
FIG. 3D illustrates side view of the top stop according to the present application.

In this embodiment, top stop 30 is integrally injected onto the fastener tape by injection molding. The top stop 30 as with the coupling elements 14*a* 14*b* is similarly fixed to the coupling edge 16 of the tape encompassing the first planar surface and the second planar surface with an extension extending towards the outer edge 17 of the tape of the stringer 12*a*. The top stop 30 has a first body portion 31*a* on the side of the first planar surface (FIG. 3A) and a second body portion 31*b* on the side of the second planar surface (FIG. 3B). That is, the top stop includes two body portions mounted on opposing planar surfaces of the tape of the stringer 12*a*, 12*b*. The top stop 30 may be formed as a singular component around the tape, for example, the first and second body portions 31*a*, 31*b* may be integrally formed around the tape. Alternatively, they may be distinct body portions which are joined together around the tape. Side views of the top stop are shown in FIGS. 3C and 3D. The body portions meet, or join, or converge around the coupling edge of the tape such that the inlets 32 of channels 36 are provided at the coupling edge 16 of the tape (FIG. 3C), and the outlets 34 of the channels 36 are provided more proximate to the outer edge 17 of the tape (FIG. 3D). Although not shown in FIG. 3D, the top stop 30 can be provided with a groove to receive the fastener tape. In some examples, top stop 30 is substantially rectangular.

The top stop 30 is provided with a stop portion 33. The stop portion 33 limits the movement of the slider 20 in the first direction E. The stop portion 33 preferably extends in a direction perpendicular to the axis of operation so that when approached by the slider 20, a part of the slider body 21, for example a flange 24*a* comes into contact with the stop portion 33. The stop portion 33 is located distally (relative to the rest of the top stop) from the coupling edge of the stringer 12*a* and is located above a channel 36 in the first sliding direction E. The channel 36 is provided in the top stop 30 to facilitate removal of the slider 20 from the stringer 12*a*. That is, the stop portion 33 protrudes from the first and second body portions 31*a*, 31*b* of the top stop 30 toward the outer edge 17 of the tape. The stop portion 33 may be included within at least one of the first and second body portions 31*a*, 31*b* of the top stop 30.

Top stop 30 includes a channel 36 having an inlet 32 and an outlet 34, and a channel bottom surface 35. The channel 36 is configured to receive a portion of the slider, for example a flange 24*a* provided on the slider 20. The channel 36 is configured to allow for easy insertion of the slider onto the stringer 12*a*, 12*b*, for example to the stringer 12*a* on which the retainer box 11 and the box pin 13 are attached. That is, in normal use, the top stop 30 will prevent movement of the slider 20 in the first sliding direction E beyond the row of coupling elements 14*a* and the box pin 13 (or the retainer box 11 or both) will prevent movement of the slider 20 beyond the row of coupling elements 14*a* in the second sliding direction D, thus ensuring that the slider 20 does not accidentally come away from the row of coupling elements 14*a*.

The channel 36 is also configured to facilitate the removal of the slider 20, should this be required, for example to replace a broken or faulty slider. The inlet 32 to the channel 36 is formed at the side of the top stop 30 at the coupling edge 16 of the tape of the stringer 12*a*. The inlet 32 of the channel may optionally be provided with a recess 32*a*. The outlet 34 is formed at the side of the top stop 30 proximal to the outer edge 17 of the tape and is located below the stop portion 33. That is, the outlet 34 is positioned between the end of the row of coupling elements proximate to the top stop 30 and the stop portion 33 of the top stop 30. The outlet 34 is located closer to the top end 18*a* of the coupling elements row 14*a* than the inlet 32.

Thus the inlet 32 is the mouth of the top stop 30 through which a slider 20 may enter the channel 36 in order for the slider 20 to be inserted onto the slide fastener chain 18 and the outlet 34 is the mouth of the top stop 30 from which a slider 20 may exit the channel 36 of the top stop 30 in order to slide onto the row of coupling elements 14*a* to complete the insertion. It can be understood that when it is intended to release the slider 20 from the row of coupling elements 14*a*, the inlet 32 and outlet 34 function in the opposite manner. However for consistency, the meaning of these terms will remain static and not change depending on the direction of movement of the slider 20.

Channel 36 includes a channel first side wall 38 and a channel second side wall 37 and a channel bottom surface 35. The channel first side wall 38 is disposed more proximate to the row of coupling elements of the stringer 12*a* than the channel second side wall 37. The channel first side wall 38 and the channel second side wall 37 are opposed to each other, the channel bottom surface 35 of the channel 36 includes a flat surface, and connects the channel first side wall 38 and the channel second side wall 37. That is, a groove extending from the inlet 32 to the outlet 34 is formed as the channel 36. It can be understood that, in some embodiments, the channel bottom surface 35 may include the tape 12*a*. Accordingly, the first, or second, or both body portions 31*a*, 31*b* may include two distinct sections which are separated by a channel width, thereby forming the channel 36 (or valley) in between the sections. As such, a channel (or valley) bottom surface 35 may include (or be defined in part by) the fastener tape 12*a*. In other examples, the channel bottom surface 35 may include the same material as the top stop. In such cases, the first, or second, or both body portions 31*a*, 31*b* may include a singular component having a channel 36 formed in body portion.

The channel first side wall 38 has a substantially flat or straight profile and extends at constant incline down from the inlet 32 of the channel to the outlet 34. The channel second side wall 37 includes a stepped profile to provide the channel 36 with varying widths across the length of the channel 36. The channel width at any point along the channel is defined as the distance parallel to the longitudinal axis of the top stop between the channel first and second side walls. In normal use, the longitudinal axis of the top stop is brought parallel to the axis of operation (A) (or longitudinal axis) of the slide fastener. The width of the channel 36 at the inlet 32 is denoted by letter F.

The channel second side wall 37 extends at an incline from the inlet 32, narrowing the width of the channel to an end point 37*b* of an abutment protrusion 37*a*. The channel width extending from the abutment protrusion 37*a* at the end point 37*b* to the channel first side wall 38 is denoted by letter G. This end point 37*b* may also be defined as the release point for a flange 24*a* of the slider received in the channel 36 during the operation to release a slider 20 from the row of coupling elements 14*a*. The channel second side wall 37 then extends away from the channel first side wall, widening the channel 36, to form the abutment protrusion 37*a*. The channel width at this point is denoted by letter H. The channel second side wall 37 includes another protruding portion where the channel second side wall 37 extends towards the channel first side wall 38 and out again to form an outlet protrusion 39 at the outlet 34. The channel width 36 at this point is denoted by letter J.

The top stop 30 of this example is therefore provided with two stepped regions, one adjacent the outlet in the form of the outlet protrusion 39 and another in the form of the abutment protrusion 37*a*. The channel width of the channel 36 at the end point 37*b* of the abutment protrusion 37*a*, the release point, G is less than the channel width of the inlet 32 and also the channel width of the outlet (F>G, J>G). The channel width H of the channel 36 intermediate the abutment protrusion 37*a* and the outlet protrusion 39 is greater than the channel width J at the outlet 34 and the width G at the end point 37*b* of the abutment protrusion 37*a* (H>J>G). In this embodiment, the channel width G of the channel 36 at the end point 37*b* of the abutment protrusion has a minimum width in the width of the channel 36, and this channel width G is greater than the thickness of the flange 24*a*. Further, the channel width at the inlet 32 may be smaller than the channel width H of the channel 36 intermediate the abutment protrusion 37*a* and the outlet protrusion 39. In addition, the channel width F at the inlet 32 may be larger than the channel width J at the outlet 34.

The distance between the end of the row of coupling elements 14*a* proximate to the top stop 30 and the outlet 34 is less than the distance between the end of the row of coupling elements 14*a* proximate to the top stop 30 and the inlet 32, in consequence the channel first side wall 38 of the channel 36 inclines away from the axis of operation A of the slide fastener by an angle of less than 90 degrees.

The channel second side wall 37 has at least three flat surfaces. A first flat surface is formed between the inlet 32 and the end point 37*b* of the abutment protrusion 37*a*, and inclines with respect to the second direction D. This inclination may be more acute than that of the channel first side wall or it may be the same. In other embodiments, it may be less acute. A second flat surface is formed between the end point 37*b* of the abutment protrusion 37*a* and the base (root) of the outlet protrusion 39. A third flat surface is formed between the base of the outlet protrusion 39 and an end point 39*a* of the outlet protrusion 39 or in embodiments which do not have an outlet protrusion, the outlet 34.

In the example of FIGS. 2 and 3D, the channel is provided on both the first and second body portions 31*a*, 31*b* of the top stop 30. Accordingly, there are two inlets 32 at the coupling edge 16, and two outlets 34 at the side of the top stop proximal to the outer edge 17 of the tape, allowing for passage of an upper and lower flange 24*a* provided on the slider. In such embodiments, the flange protruding from the upper blade 23 of slider 20 can enter inlet 32 provided on the first body portion 31*a* of the top stop 30, and the flange protruding from the lower blade of the slider 20 can enter inlet 32 provided on the second body portion 31*b* of the top stop 30.

Figure 4:
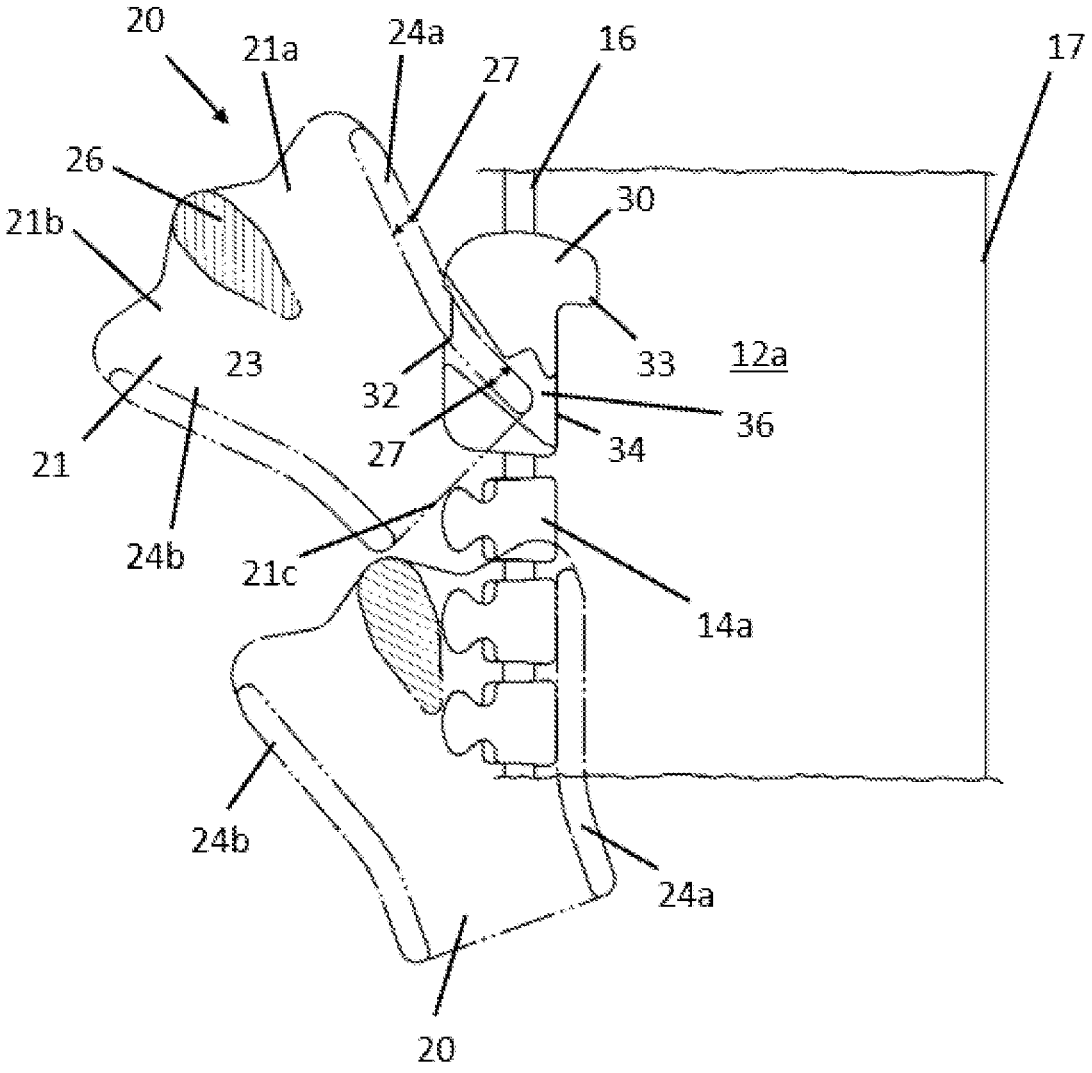
FIG. 4 illustrates the insertion of the slider onto a fastener stringer including a top stop of the present application.

The slider 20 can be mounted to the stringer of the slide fastener as shown in FIG. 4. In FIG. 4, the upper blade 23 of the slider 20 has been removed to allow views of the flanges 24*a*, 24*b* and guide post 26. The width 27 of flange 24*a* may be defined as the distance by which the flange 24*a* extends normally to the right side edge of the upper blade 23 (or left side edge of flange 24*b*). The length of the flange 24*a* may be defined as the distance by which the flange 24*a* extends parallel to the right side edge (or left side edge of flange 24*b*). In FIG. 4, the width 27 of flange 24*a* is marked in two locations along the flange 24*a*. In this example, the width 27 of the flange 24*a* is constant across the length of the flange 24*a*. However, it can be understood that in some examples, the flange 24*a* or flanges 24*a*, 24*b* may be provided with different widths at different locations along the length of the flange 24*a* or flanges 24*a*, 24*b*.

Flange 24*a* enters the channel 36 at the inlet 32. The channel width along the length of the channel 36 is always wider than the width of the flange 24*a*. Furthermore, the thickness between the channel bottom surfaces 35 of each channel 36 provided on the first and second body portions 31*a*, 31*b* of the top stop 30 is narrower than the gap between the flange 24*a* of the upper blade 23 and the flange of the lower blade, as such, the slider 20 can pass through the top stop 30. The tape of the stringer 12*a* may be manipulated, for example by flexing, and or folding the tape material, and the slider may be pulled via the pull tab 25 such that the flange 24*a* is translated through the channel 36 out of the outlet 34 and into sliding engagement with the coupling elements adjacent the top stop 30. It can be understood that a lower flange provided on the lower blade of the slider 20 may translate through the channel 36 provided on the second body portion 31*b* of the top stop 30. The slider 20 may then be moved in the second sliding direction D down the row of elements 14*a* so that the insertion pin 15 can be used to position the row of coupling elements 14*b* of the second stringer 12*b* and allow operation of the slide fastener.

In normal use, the slider 20 is pulled in the first direction E to interdigitate the coupling elements 14*a*, 14*b* and at the end of the slider's intended travel (the end of the slide fastener), the leading end of flange 24*a* of slider 20 will abut on the stop portion 33, preventing further travel of the slider 20. In the event that some misalignment of the slider 20 occurs, for example by the application of force in a direction other than the first direction E or second direction D, the flange 24*a* of slider 20 will abut on outlet protrusion 39 of channel 36, preventing the leading end of flange 24*a* from entering the channel 36 at the outlet 34. Accordingly, the outlet protrusion 39 can prevent accidental disengagement of the slider from the remaining slide fastener during normal operation.

Figure 5A:
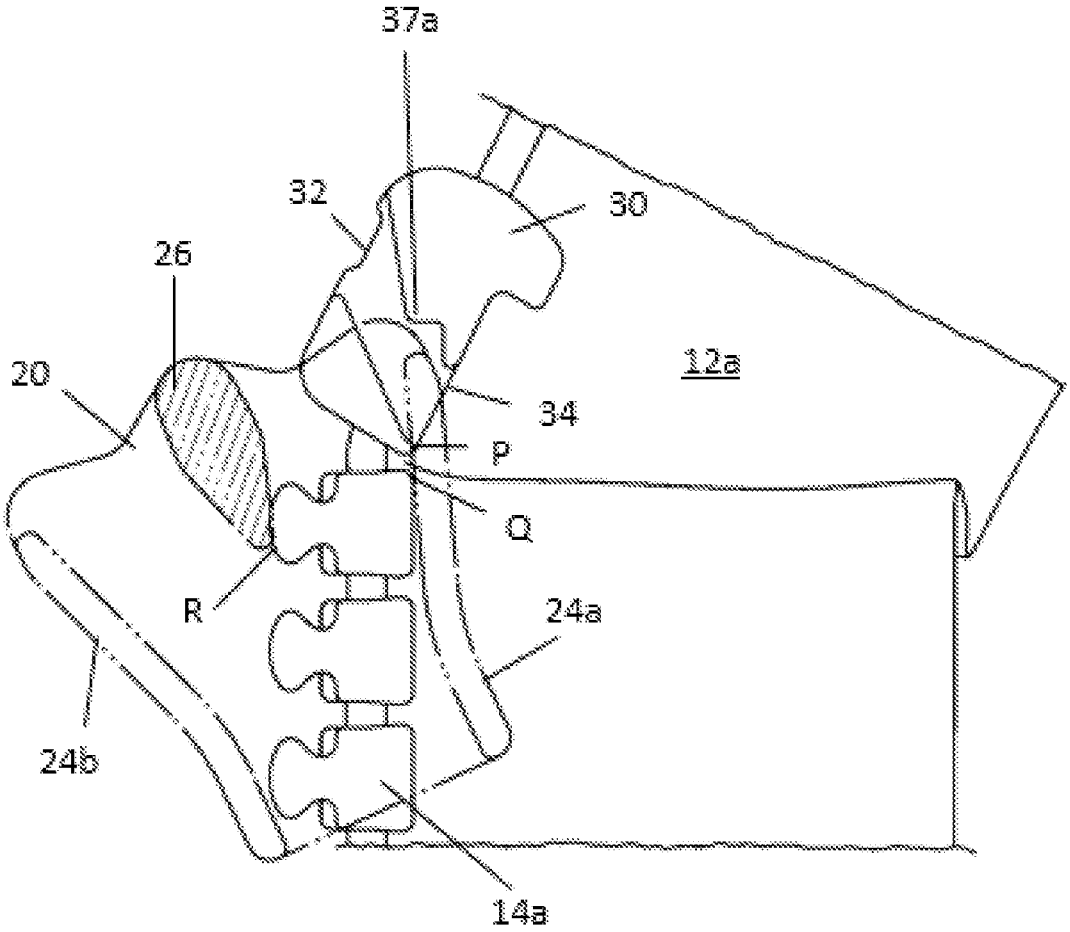
FIG. 5A illustrates the removal of the slider from a fastener stringer including a top stop of the present application.
Figure 5B:
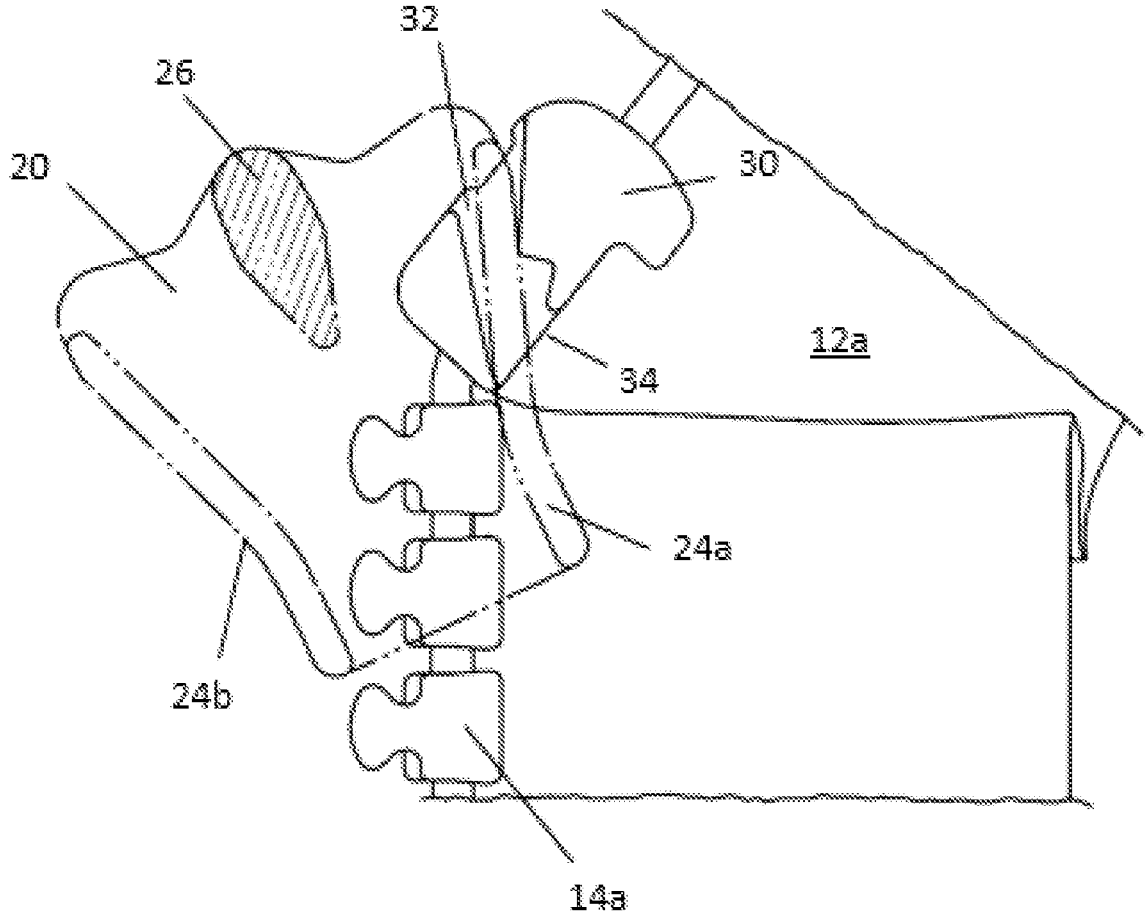
FIG. 5B illustrates the removal of the slider from a fastener stringer including a top stop of the present application.

The slider 20 can be intentionally removed from the slide fastener as shown in FIGS. 5A and 5B. In FIG. 5A, the tape of the stringer 12*a* is manipulated and the slider is twisted to allow flange 24*a* of slider 20 to enter the outlet 34 of the channel 36 formed in top stop 30. Manipulation, in the form of folding or flexing of the tape material, for example folding a portion of the tape back on itself, or flexing in a direction at an angle to the axis of operation A, allows the flange 24*a* to bypass the outlet protrusion 39, and enter the channel 36. Such flexing of the tape material may be flexing in the plane of the tape. The flange 24*a* is pulled further into the channel until the leading end of the flange 24*a* abuts on the abutment protrusion 37*a*. Accordingly, abutment protrusion 37*a* can provide a further stop to prevent accidental disengagement of the slider.

If removal of the slider is desired, the slider 20 can then be pivoted around pivot point P. Therefore the flange 24*a* can translate through the release point of the abutment protrusion 37*a* (FIG. 5B) allowing the slider 20 to be disengaged from the slide fastener.

Pivoting the slider 20 around pivot point P rotates the guide post 26 bringing it into contact with the uppermost coupling element 14*a* of the stringer 12*a*. The guide post 26 pushes against the coupling element 14*a* at point R bringing the coupling element 14*a* into contact with the flange 24*a* at point Q. A reaction force from the tape via the coupling element 14*a* is also exerted on the guide post 26. In order to translate the flange 24*a* through the release point of the abutment protrusion 37*a*, the force applied to pivot the slider 20 around pivot point P has to be greater than the reaction force at point R from the coupling element 14*a* on the guide post 26.

In the example shown in FIG. 5A, the slider may be rotated in an anticlockwise direction but it can be understood that the rotation may be dependent upon the orientation of the top stop and the slider on the stringer.

The amount of force required to pivot the flange 24*a* will be dependent upon the distance perpendicular to the longitudinal axis from the outlet 34 to the release point of the abutment protrusion 37*a*. This distance determines the degree to which the coupling element 14*a* needs to move from its normal axis in order to allow the flange 24*a* to travel and pass the abutment protrusion 37*a*, that is, against the reaction force applied to the guide post 26. The greater this distance, the more the coupling element 14*a* and tape need to be deflected, resulting in a greater reaction force on the guide post 26 and hence a greater force to pivot the flange 24*a* will be required. As such, the top stop may be tailored to require a minimum force in order to disengage a slider from the slide fastener.

Further manipulation of the stringer 12*a*, for example by folding the stringer, maintains contact between the flange 24*a* and the coupling element 14*a* at point Q, helping to maintain the flange 24*a* in the orientation required to pass through channel 36 of the top stop 30. Alternatively or simultaneously, once the flange 24*a* has pivoted and been released from the abutment protrusion 37*a*, the slider may be pulled (generally upwards in the orientation of the figure) to translate the flange 24*a* through channel 36, releasing the slider from the slide fastener.

Figure 6:
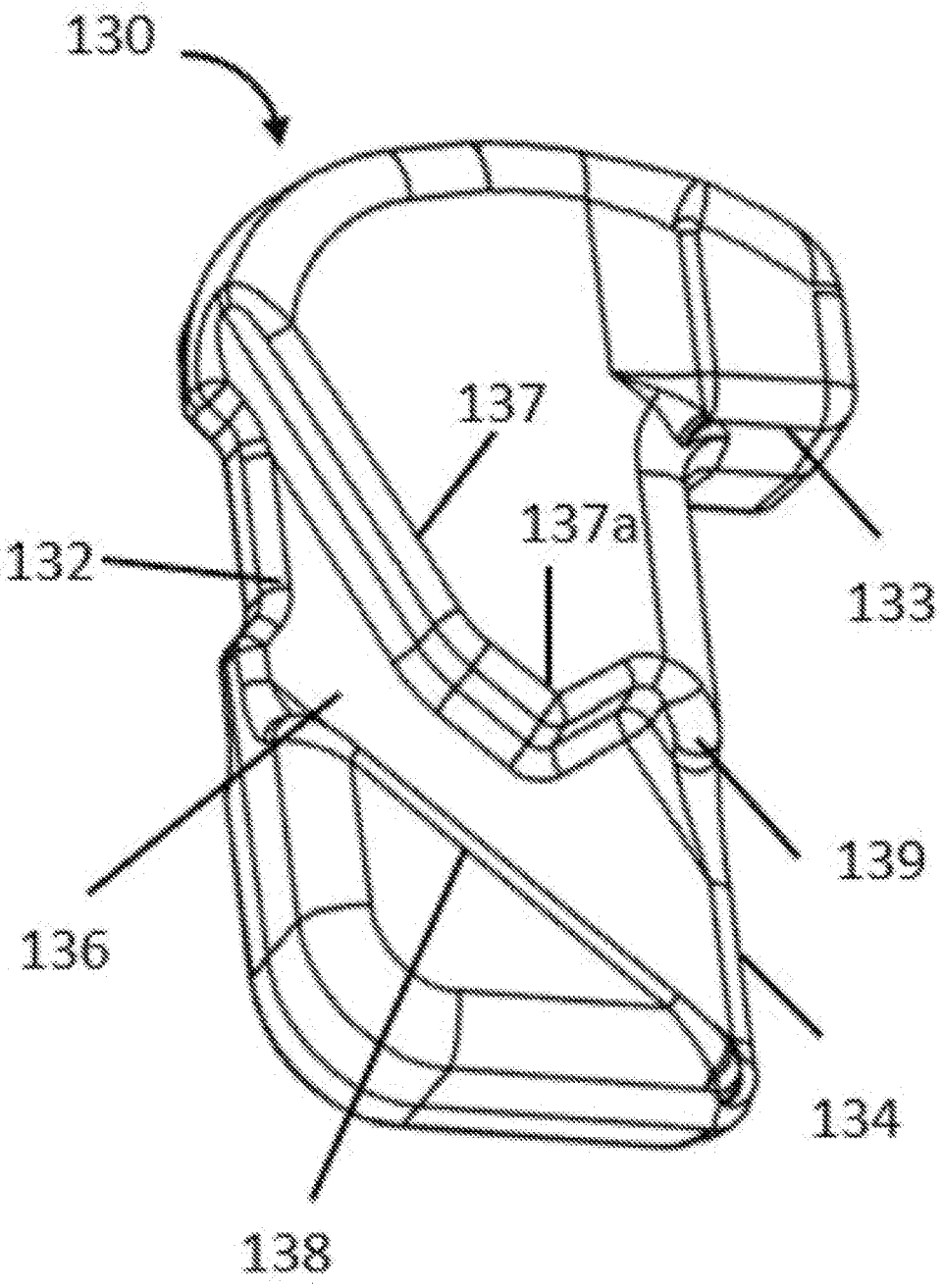
FIG. 6 illustrates a perspective view of an alternative top stop according to the present application.
Figure 7:
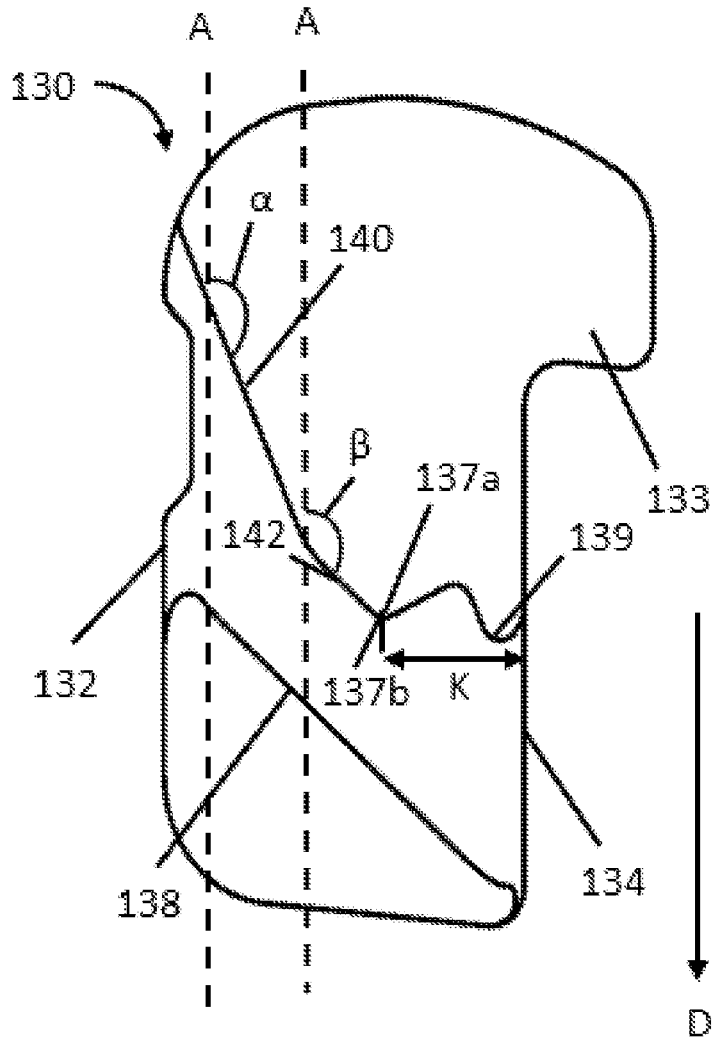
FIG. 7 illustrates a front view of the top stop shown in FIG. 6.

An alternative top stop 130 is shown in FIGS. 6 and 7. Top stop 130 is shown in perspective view in FIG. 6. Unless otherwise specified, the features of the top stop 130 which are the same as the previous example are denoted with the like reference numerals incremented by 100 and are not described again for brevity.

The channel 136 of top stop 130 is also provided with protruding portions. In this example, the channel second side wall 137 includes a first incline 140 starting at the inlet 132 and extending to a second incline 142, the first incline 140 having a first angle α relative to the longitudinal axis A of the top stop 130, with respect to the second direction D. This first incline 140 extends to the second incline 142, the second incline having a second angle β relative to the longitudinal axis A of the top stop with respect to the second direction D. In this example, both the first angle α and second angle β are obtuse angles (although this may not always be the case) and, the second angle β is less (or less obtuse) than the first angle α of the first incline 140. The channel second side wall 137 then extends away from the channel first side wall 138 forming the abutment protrusion 137*a*. The distance K perpendicular to the longitudinal axis of the top stop between release point 137*b* of the abutment protrusion 137*a* and the outlet 134 is larger than the width of the flanges of the slider, and accordingly, a greater force is required to pivot the slider through the release point. The top stop 130 also includes an outlet protrusion 139 which is formed by the channel second side wall 137 extending towards the channel first side wall 138 and then away from again at the outlet 134 of channel 136.

Figure 8A:
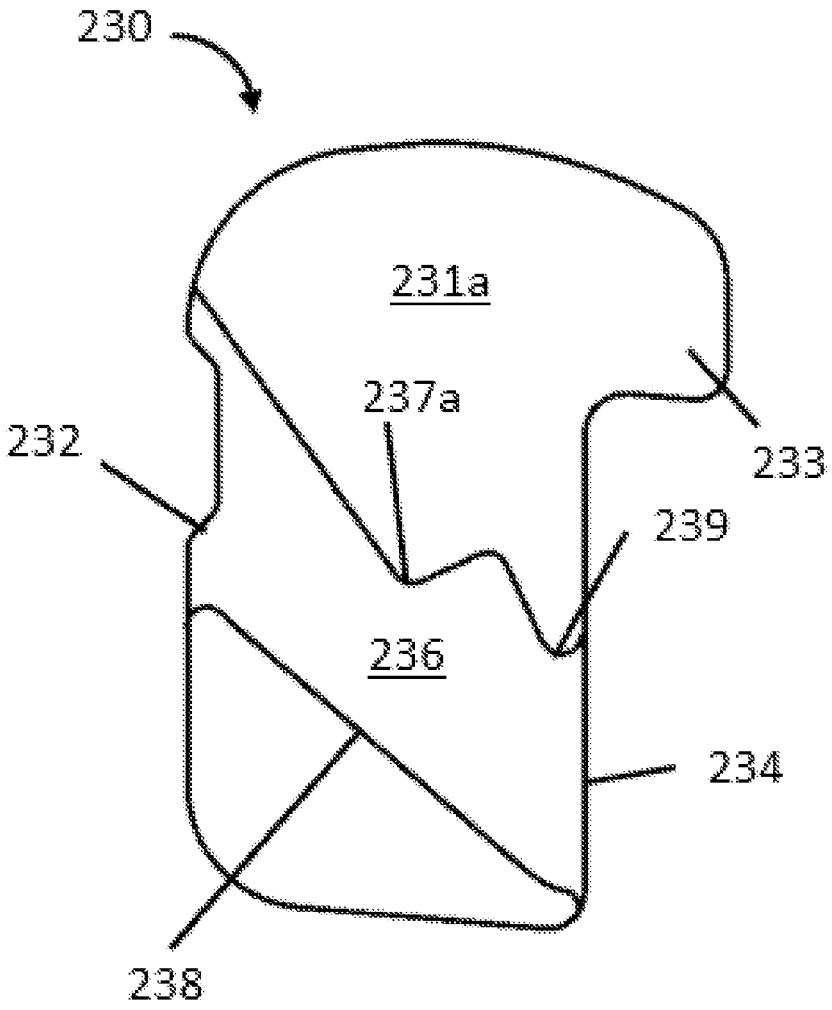
FIG. 8A illustrates an alternative top stop of the present application.
Figure 8B:
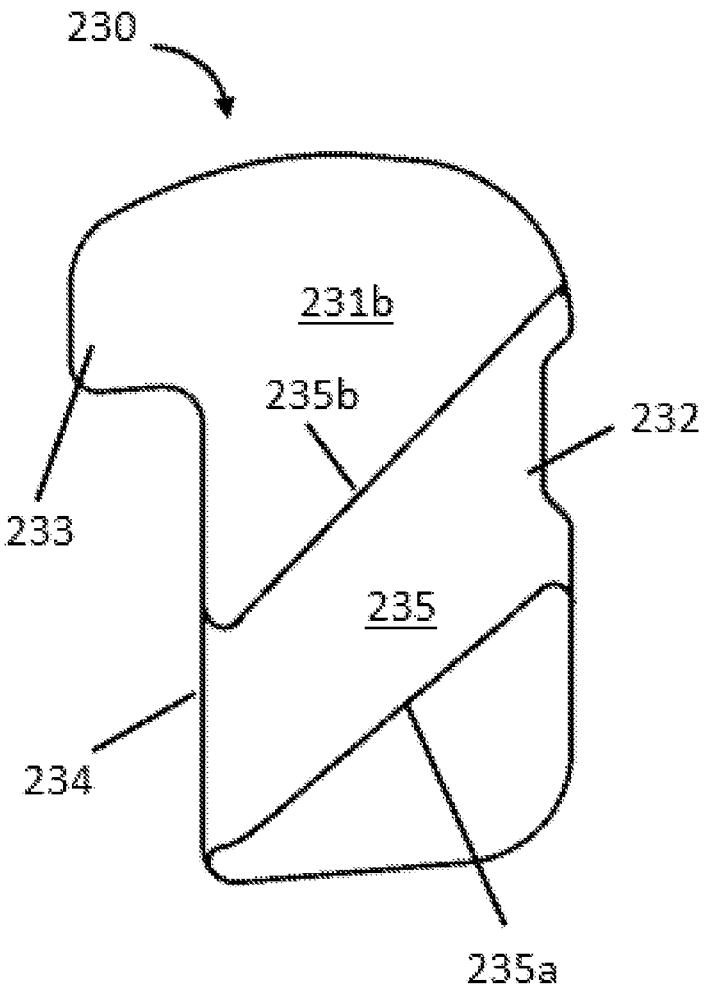
FIG. 8B illustrates an alternative top stop of the present application.
Figure 9A:
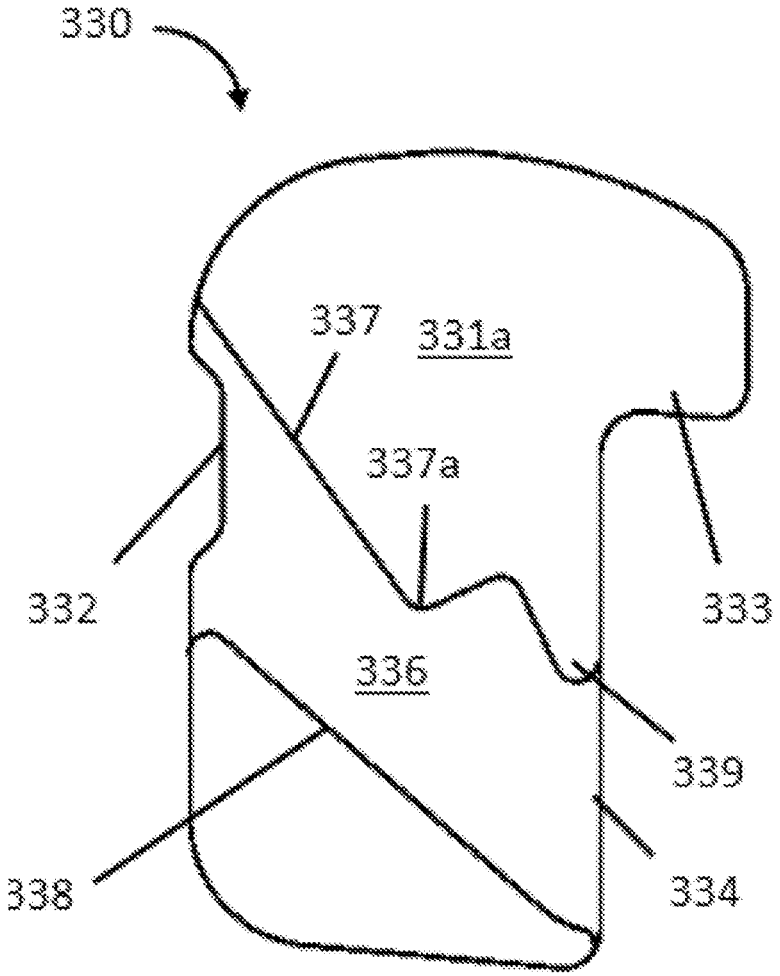
FIG. 9A illustrates front view of an alternative top stop of the present application.
Figure 9B:
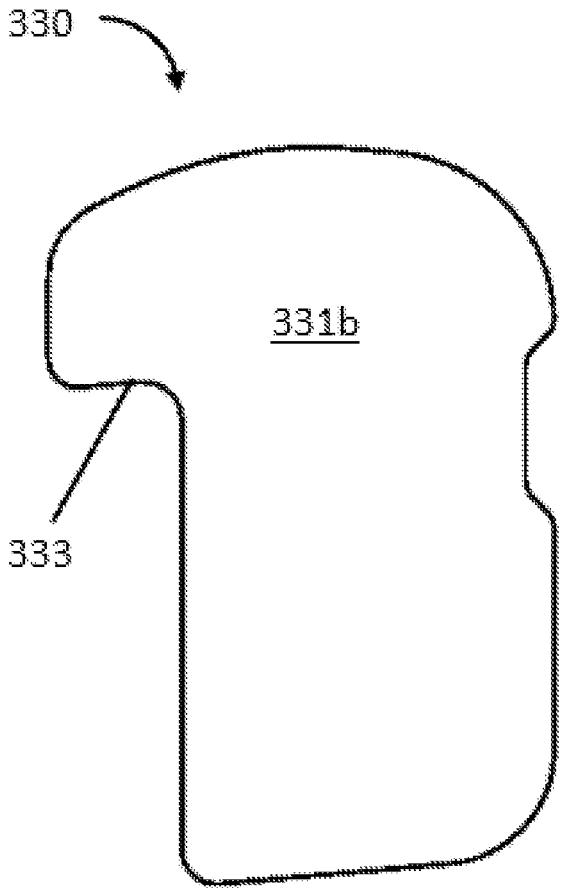
FIG. 9B illustrates back view of an alternative top stop of the present application.
Figure 9C:
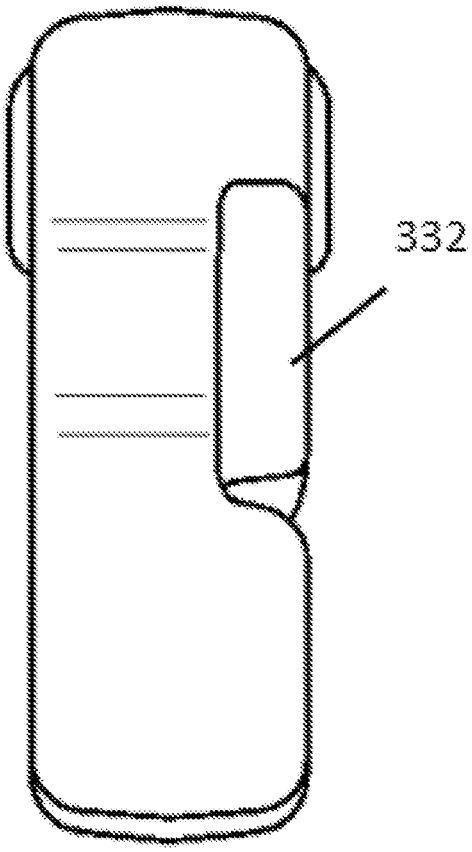
FIG. 9C illustrates side view of an alternative top stop of the present application.
Figure 9D:
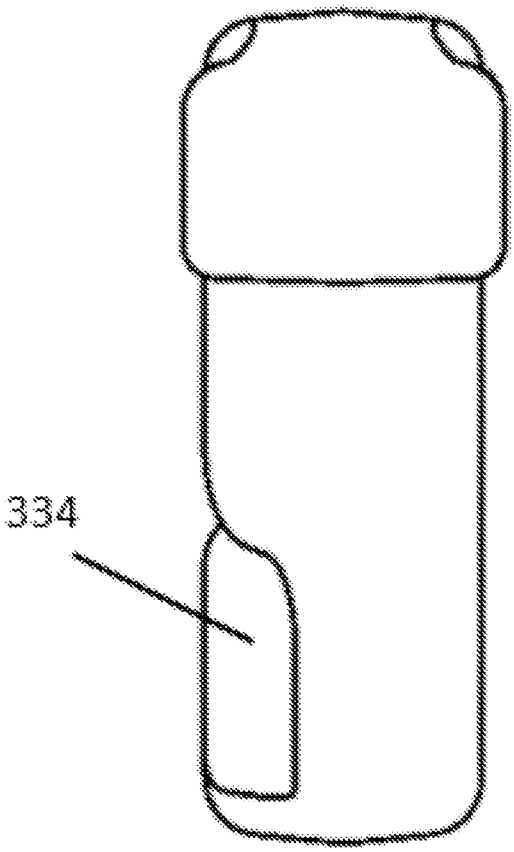
FIG. 9D illustrates side view of an alternative top stop of the present application.

Another form of top stop 230 is illustrated in FIGS. 8A and 8B. Unless otherwise specified, the features of the top stop 230 which are the same as the previous example are denoted with the like reference numerals incremented by 200 and are not described again for brevity. Top stop 230 is formed around the coupling edge of the stringer 12*a* or 12*b* and includes a first body portion 231*a* (FIG. 8A) and second body portion 231*b* (FIG. 8B), one positioned on each planar surface of the tape of the stringer 12*a* or 12*b*. First body portion 231*a* is provided with a channel 236 having an abutment protrusion 237*a* and an outlet protrusion 239. The protrusions 237*a*, 239 are shown to be the same as channel 36 in top stop 30 but it can be understood that the channel 236 may be the same as channel 136 of top stop 130, both of which are described above. The second body portion 231*b* is also provided with a channel 235, and the channel 235 has a substantially constant channel width. That is, the channel first side wall 235*a* and the channel second side wall 235*b* incline against the longitudinal axis and each have substantially a flat surface.

Sliders configured to couple teeth coupling elements (as shown in FIG. 1) have upper and lower flanges provided on either side of the slider 20 to engage teeth 14*a*. Top stop 230 is provided with two channels to allow insertion and removal of such a slider, and the upper and lower flanges will interact with first and second channels of the top stop respectively. However, since only one of the channels includes the protrusions 237*a*, 239, the force required to release the slider 20 will be less because there is only one abutment protrusion 237*a* to overcome.

A further top stop 330 is illustrated in FIGS. 9A to 9D. Unless otherwise specified, the features of the top stop 330 which are the same as the previous example are denoted with the like reference numerals incremented by 300 and are not described again for brevity. Top stop 330 is formed around the coupling edge 16 of the stringer 12*a* or 12*b* and includes a first body portion 331*a* (FIG. 9A) and second body portion 331*b* (FIG. 9B), one positioned on either side of the stringer 12*a* or 12*b*. First body portion 331*a* is provided with a channel 336 substantially identical to channels 36, 236 described above. It can be understood that the channel may be formed according to channel 136, also described above. The second body portion 331*b* has a level surface, with no channel. Top stop 330 may be particularly suited for use with slide fasteners having coupling elements in the form of a continuous coil, because the coiled coupling elements are only present on a single planar surface of the tape 12*a*, 12*b*. As such, the slider will only have flanges on the upper blade or the lower blade of the slider to encourage engagement of the coupling elements on said one planar surface of the tape, thus requiring only a single channel in the top stop to facilitate the slider passing through the top stop in the same manner as already described. Alternatively, the top stop 330 may be provided with a single body portion for positioning on the planar surface of the stringer to which the coil coupling elements are attached. The single body portion may include a channel as described in the previous examples. In such an embodiment there is no second body portion on the planar surface of the stringer to which the coil coupling elements are not attached.

Although not shown in the drawings, it is also possible to use top stops according to the present application on a moveable slide fastener with two sliders. In such a case, instead of attaching a retainer box and a box pin to the bottom end of the stringer, that is, the end of the stringer opposite the top stop, it is sufficient to attach a retainer pin alone. In such an embodiment, both sliders on the stringer can make use of the top stop and be attached to or removed from the stringer.

It should be understood that the examples provided herein are merely exemplary of the present application and that various modifications may be made thereto without departing from the scope defined by the claims.

The invention claimed is:

1. A top stop for a slide fastener comprising:

a first body portion comprising a channel having an inlet at a first side of the top stop and an outlet at a second side of the top stop, the second side being opposite the first side, wherein the channel is configured to receive a portion of a slider of the slide fastener, the channel being defined by a channel first side wall and a channel second side wall, and a channel bottom surface therebetween, wherein the channel second side wall comprises a protruding portion defining an abutment protrusion in the channel, wherein the top stop comprises a longitudinal axis that is parallel to an axis of operation of the slider, and a distance parallel to the longitudinal axis of the top stop between the channel first side wall and the channel second side wall defines a channel width, wherein the channel width extending from the abutment protrusion to the channel first side wall is less than the channel width at the inlet and the channel width at the outlet, and wherein the abutment protrusion is configured to restrict travel of the portion of the slider along the channel when the portion of the slider is received in the channel and is translated from the outlet towards the inlet but still allow disengagement of the slider from a stringer of the slide fastener upon further manipulation of the slider with respect to the stringer.

2. The top stop according to claim 1, wherein a distance between the abutment protrusion and the second side of the top stop in a direction perpendicular to the longitudinal axis of the top stop, is selected such that when the portion of the slider is in contact with the abutment protrusion, the portion of the slider can be pivoted around a pivot point formed on the channel first side wall at the outlet of the channel, wherein the abutment protrusion defines a release point for the portion of the slider, and wherein the distance determines force required to pivot the portion of the slider beyond the release point and through the abutment protrusion.

3. The top stop according to claim 1, wherein the channel first side wall extends at a constant incline from the inlet of the channel to the outlet.

4. The top stop according to claim 1, wherein the channel second side wall comprises a second protruding portion defining an outlet protrusion adjacent the outlet of the channel, and wherein the outlet protrusion is configured to prevent the portion of the slider from entering the outlet of the channel.

5. The top stop according to claim 4, wherein the channel width at the inlet and the outlet is smaller than any of the channel width intermediate the outlet protrusion and the abutment protrusion.

6. The top stop according to claim 1, wherein the channel width at the inlet is larger than the channel width at the outlet.

7. The top stop according to claim 1, further comprising a stop portion located above the outlet of the channel, the stop portion being configured to limit travel of the slider along a chain of the slide fastener by abutment with the portion of the slider.

8. A slide fastener chain comprising:

a first stringer having a row of first coupling elements attached to a coupling edge of the first stringer; and a second stringer having a row of second coupling elements attached to a coupling edge of the second stringer, wherein the first and second stringers are attached to and detached from each other by interdigitating and uncoupling of the rows of the first and second coupling elements, and wherein at least one of the first and second stringers is provided with the top stop according to claim 1.

9. The slide fastener chain according to claim 8, wherein the top stop is attached to the coupling edge of the at least one of the first and second stringers, wherein the top stop is located in line with the first or second coupling elements, wherein the top stop comprises an inner portion on an inner side of the coupling edge and an outer portion on an outer side of the coupling edge, and wherein the inlet of the channel is located on the inner portion, and the outlet of the channel is located on the outer portion.

10. The slide fastener chain according to claim 9, wherein the first body portion of the top stop is mounted on a first planar surface of the at least one of the first and second stringers.

11. The slide fastener chain according to claim 9, wherein the top stop further comprises a second body portion for mounting on a second planar surface of the at least one of the first and second stringers, and wherein the second body portion comprises a second channel substantially identical to the channel of the first body portion.

12. The slide fastener chain according to claim 8, wherein the channel second side wall comprises an incline from the inlet of the channel to the abutment protrusion having a constant angle relative to the longitudinal axis of the top stop from the inlet of the channel to the abutment protrusion.

13. The slide fastener chain according to claim 8, wherein the channel second side wall comprises a first incline and a second incline, wherein the first incline extends from the inlet to the second incline at a first angle relative to the longitudinal axis of the top stop, wherein the second incline extends between the first incline and the abutment protrusion at a second angle relative to the longitudinal axis of the top stop, and wherein the second angle is less than the first angle.

14. The slide fastener chain according to claim 8, wherein the top stop is molded by injection onto the coupling edge of the at least one of the first and second stringers.

15. A method of disengaging a slider from a slider fastener, the method comprising:

translating a portion of a slider into a channel provided in a top stop of the slide fastener, the channel being defined by a channel first side wall and a channel second side wall;

abutting the portion of the slider against an abutment protrusion provided on the channel second side wall;

pivoting the slider about a pivot point on the channel first side wall at an outlet of the channel, such that the portion of the slider is rotated through a release point defined on the abutment protrusion;

translating the portion of the slider through a remaining portion of the channel to an inlet of the channel, such that the slider is removed from the top stop; and rotating the slider such that the portion of the slider can rotate through an outlet protrusion provided on the channel second side wall adjacent the outlet of the channel.

16. A top stop for a slide fastener comprising:

a first body portion comprising a channel having an inlet at a first side of the top stop and an outlet at a second side of the top stop, the second side being opposite the first side, wherein the channel is configured to receive a portion of a slider of the slide fastener, the channel being defined by a channel first side wall and a channel second side wall, and a channel bottom surface therebetween, wherein the channel second side wall comprises a protruding portion defining an abutment protrusion in the channel, wherein the top stop comprises a longitudinal axis that is parallel to an axis of operation of the slider, and a distance parallel to the longitudinal axis of the top stop between the channel first side wall and the channel second side wall defines a channel width, wherein the channel width extending from the abutment protrusion to the channel first side wall is less than the channel width at the inlet and the channel width at the outlet, wherein the channel second side wall comprises a second protruding portion defining an outlet protrusion adjacent the outlet of the channel, and wherein the outlet protrusion is configured to prevent the portion of the slider from entering the outlet of the channel.

17. The top stop according to claim 16, wherein the channel width at the inlet and the outlet is smaller than any of the channel width intermediate the outlet protrusion and the abutment protrusion.

* * * * *